US010912424B2

(12) United States Patent
Ouzilleau

(10) Patent No.: US 10,912,424 B2
(45) Date of Patent: Feb. 9, 2021

(54) STUD ATTACHMENT WITH PAN LINER HOLDER

(71) Applicant: Serge Ouzilleau, West Palm Beach, FL (US)

(72) Inventor: Serge Ouzilleau, West Palm Beach, FL (US)

( * ) Notice: Subject to any disclaimer, the term of this patent is extended or adjusted under 35 U.S.C. 154(b) by 0 days.

(21) Appl. No.: 16/731,931

(22) Filed: Dec. 31, 2019

(65) Prior Publication Data

US 2020/0367700 A1 Nov. 26, 2020

Related U.S. Application Data

(60) Provisional application No. 62/851,947, filed on May 23, 2019.

(51) Int. Cl.
*A47K 3/40* (2006.01)

(52) U.S. Cl.
CPC ..... *A47K 3/40* (2013.01)

(58) Field of Classification Search
CPC ..... A47K 3/40
USPC ..... 4/614
See application file for complete search history.

(56) References Cited

U.S. PATENT DOCUMENTS

| | | | |
|---|---|---|---|
| 3,158,237 | A | 11/1964 | Schooler |
| 3,312,032 | A | 4/1967 | Ames |
| 4,993,201 | A | 2/1991 | Bunyard |
| 2008/0222797 | A1 | 9/2008 | Cook |
| 2013/0086849 | A1 | 4/2013 | Clouser et al. |
| 2018/0319574 | A1 | 11/2018 | Wallis |

*Primary Examiner* — Jeeremy Carroll
(74) *Attorney, Agent, or Firm* — Law Office of Scott C Harris

(57) ABSTRACT

A special shaped stud attachment for holding a panel liner into place has surfaces for attaching to metal studs, surfaces for holding the pan liner, and a liner holding pocket that holds the liner under the level of the wall material.

8 Claims, 5 Drawing Sheets

STUD ATTACHMENT WITH PAN LINER HOLDER

This application claims priority from Provisional application No. 62/851,947, filed May 23, 2019, the entire contents of which are herewith incorporated by reference.

BACKGROUND

Pan liners are used around the bottom of a shower enclosure to waterproof the shower enclosure. The pan liners are attached to the wall and waterproofed. This can be a complicated and labor-intensive process.

SUMMARY OF THE INVENTION

The present application describes an integral pan liner stud which attaches to a wall stud and to a floor track or stud, and which holds a shower pan liner in place. In different embodiments, the pan liner can be made of various materials, but is preferably made of a plastic or resin, or a waterproof moldable or machineable material.

Other embodiments are described herein.

BRIEF DESCRIPTION OF THE DRAWINGS

In the Drawings.

the figures describe aspects of the invention, as described herein, and specifically.

DETAILED DESCRIPTION

Embodiments describe a pan liner attachment stud, and show how a pan liner can be easily attached to the attachment part.

Figure 1:
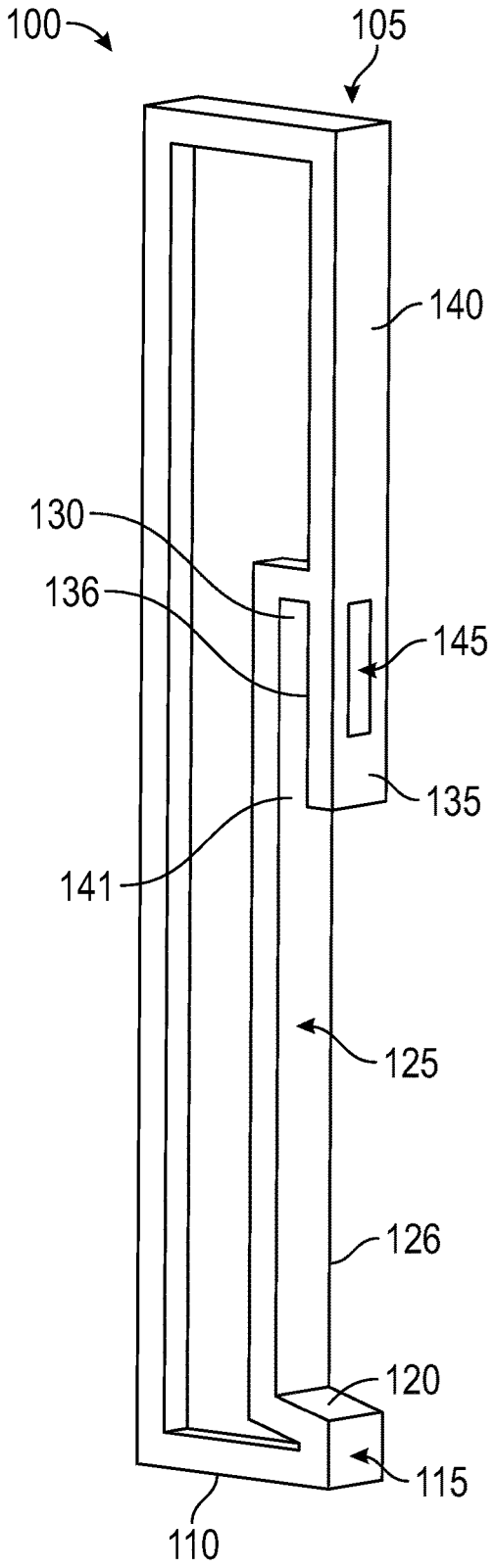
FIG. 1 shows a front perspective view of the special stud attachment device.

FIG. 1 shows a front perspective view of the pan liner stud 100, and its different parts. The pan liner stud has a top part 105 which connects to a metal stud, and a bottom part 110 which fits into a track of a metal stud. In another embodiment where this device is used with other studs such as wood studs, this can be nailed or otherwise attached to the bottom stud.

Figure 3:
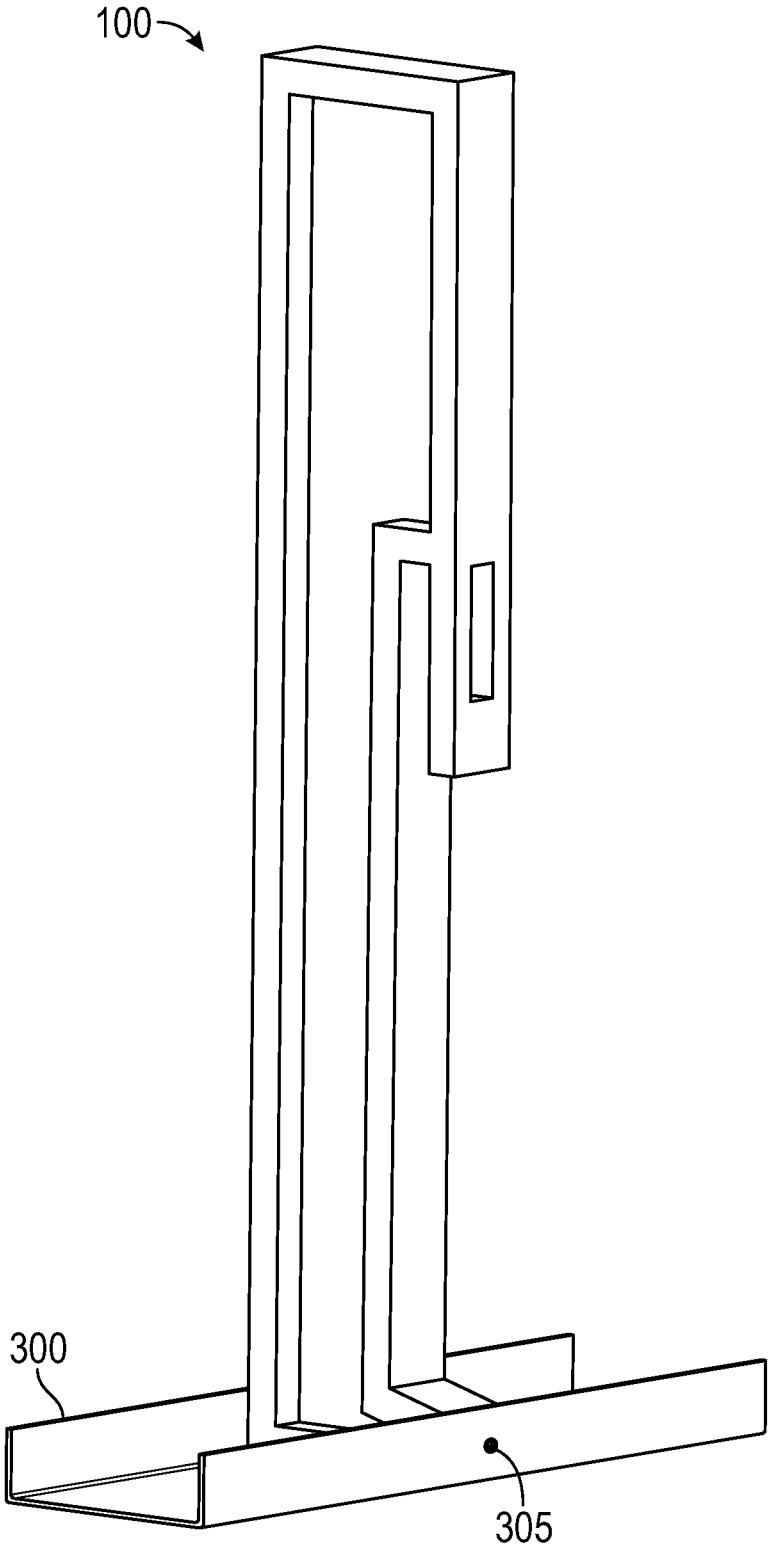
FIG. 3 shows the device attached to a bottom stud track.

The bottom part 110 of the pan liner stud 100 has an front end part 115 which is attached to an inside surface of a track 300 of the metal stud (as shown in FIG. 3). A stud connecting surface 140 is coplanar to the end surface 115. The stud connecting surface 140 itself connects to the stud.

Figure 5:
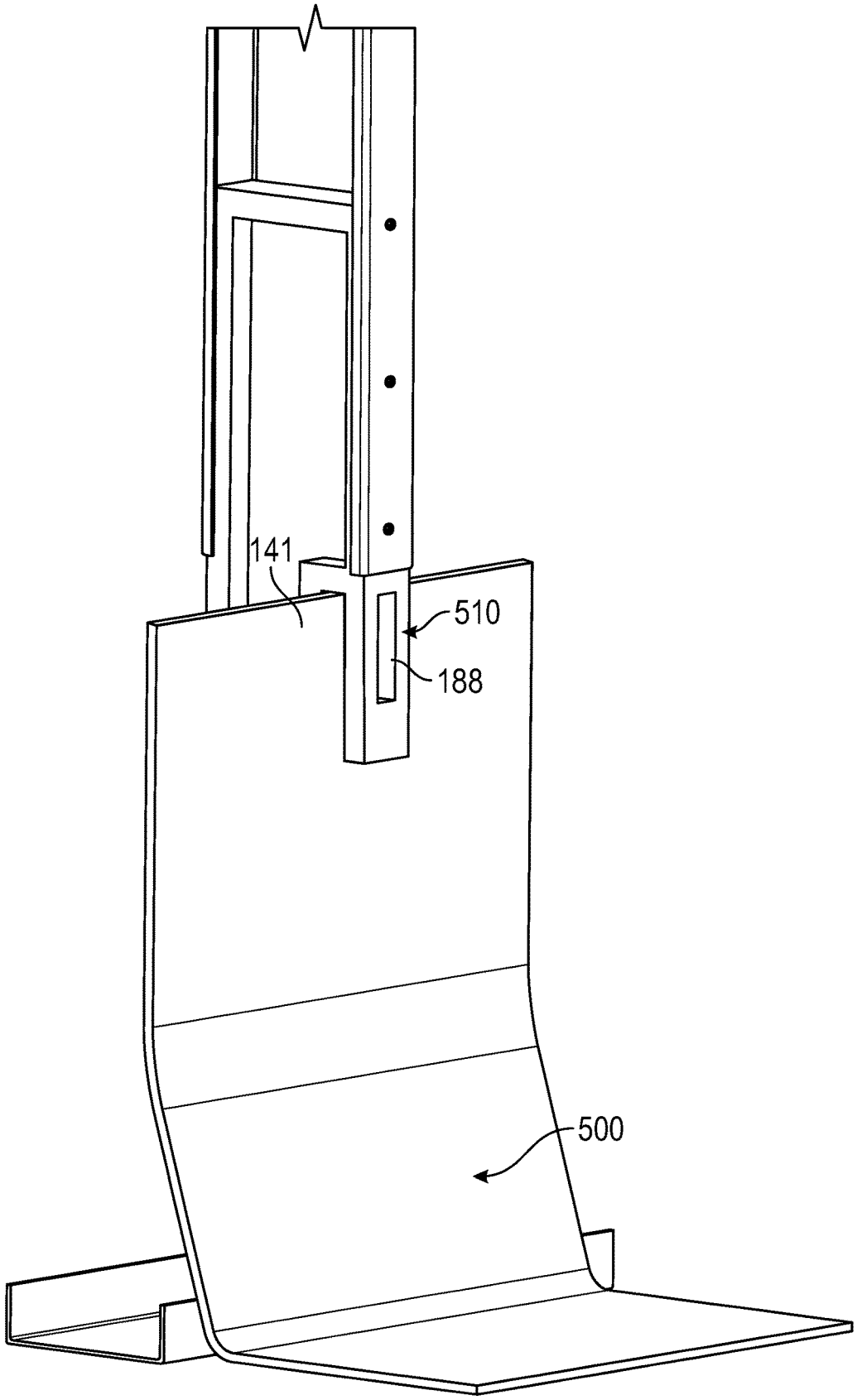
FIG. 5 shows the device with a pan liner attached.
Figure 6:
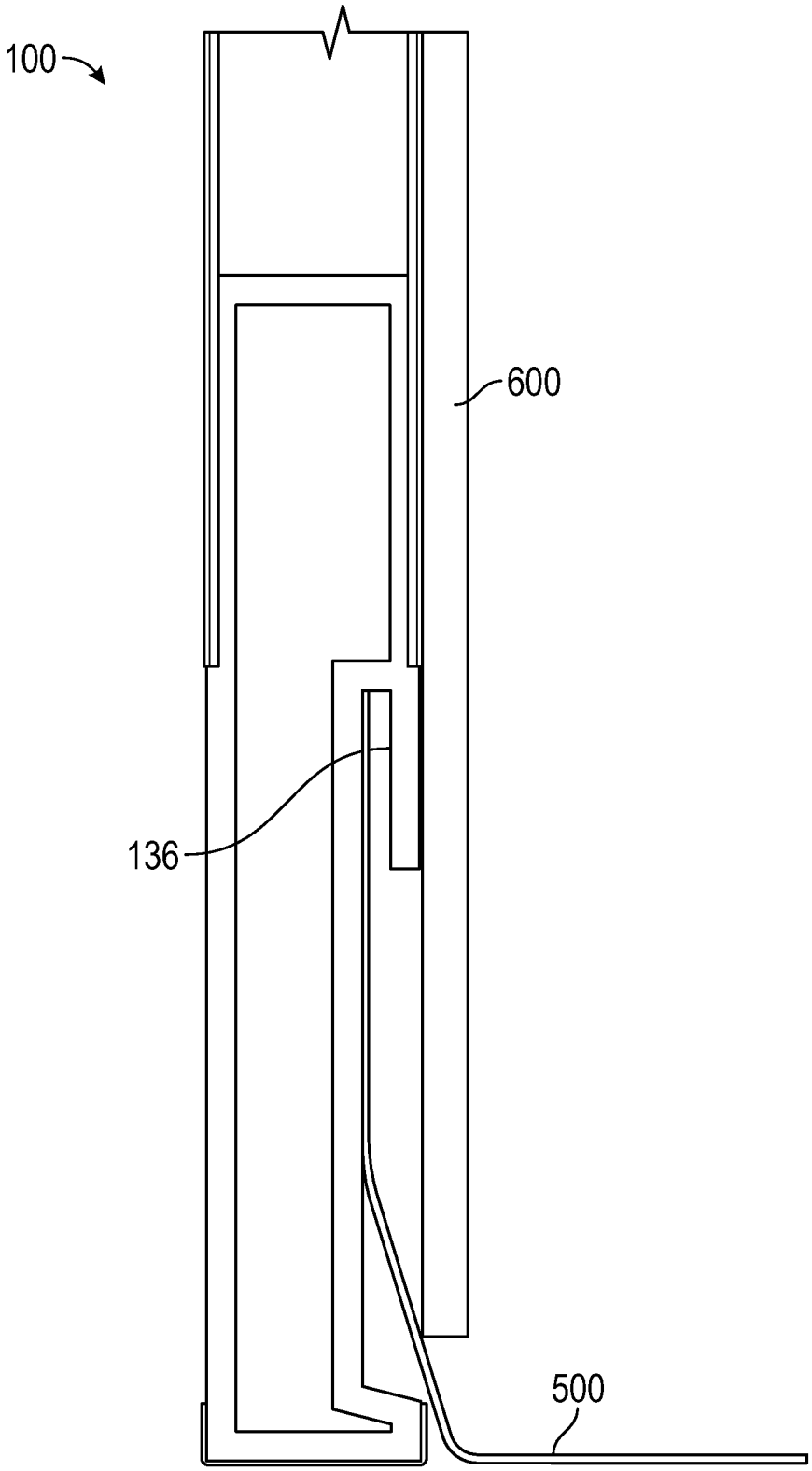
FIG. 6 shows a side view of the device attached to studs and with the pan liner attached.

There is a recess 125, separating the end surface 115 from the stud connecting surface 140. The pan liner is held in this recess below the level of the overlying wall material, see FIG. 5, and FIG. 6 shows how the wall board material 600 can cover the pan liner without any fasteners piercing the pan liner.

The end part 115 provides a front surface that can attach to a wall track. The end part 115 adjoins a slightly beveled part 120 which bevels inward (away from the stud connecting surface 140), forming a bottom side of recessed area 125. The recessed area is recessed relative to the surfaces 115, 140 of the stud 100 and provides space for the pan liner. The surfaces of this type are provided for holding the pan liner below the surface into which fasteners are attached, this also prevents the fasteners from piercing the pan liner, providing on interrupted protection by the pan liner.

The recessed area 125 extends between the edge of the beveled part 120, and another end part 130 that forms the end of the bevel. A pocket section 135 forms a stud pocket area 141 between the inside surface 126 of the recess 125, and the inside surface 136 of the section 135. The pocket has a top surface that acts as a stop for the pan liner and thus sets the end location of the pan liner, in an area under the wallboard.

The stud pocket section 135 also includes a hole tab 145 which creates a location to allow screwing a pan liner into place at its top, as explained herein.

Figure 2:
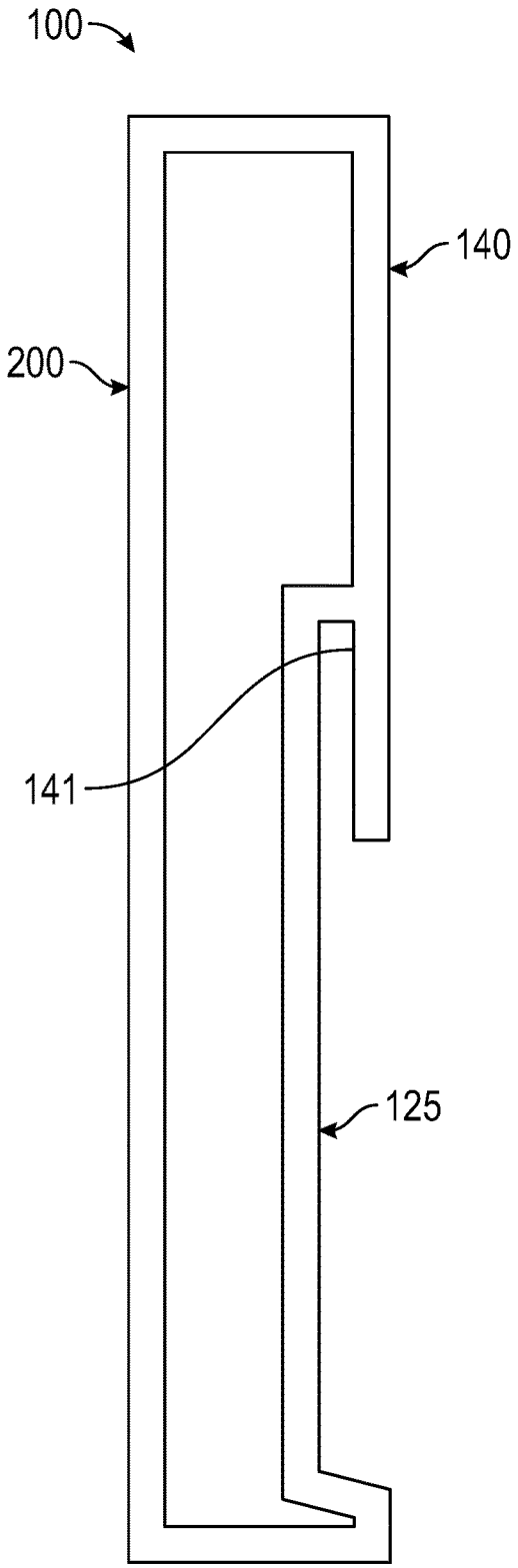
FIG. 2 shows a side perspective view of the stud attachment device.

FIG. 2 shows a side view, showing the front stud connecting surface 140 forms an area for attachment to the front of the metal stud, that is the side that receives the wallboard attached to it. The opposite surface 200 also forms a surface for attachment to the rear of the metal stud. The recess 125 forms an area for the pan liner, to fit within the recess, and be held at the top by the stud pocket area 141, and held recessed relative to the level where the wallboard will be attached.

FIG. 3 illustrates how the pan liner stud 100 is attached into a metal track 300 of a metal stud system. A screw 305 is attached to hold the studs into the track.

Figure 4:
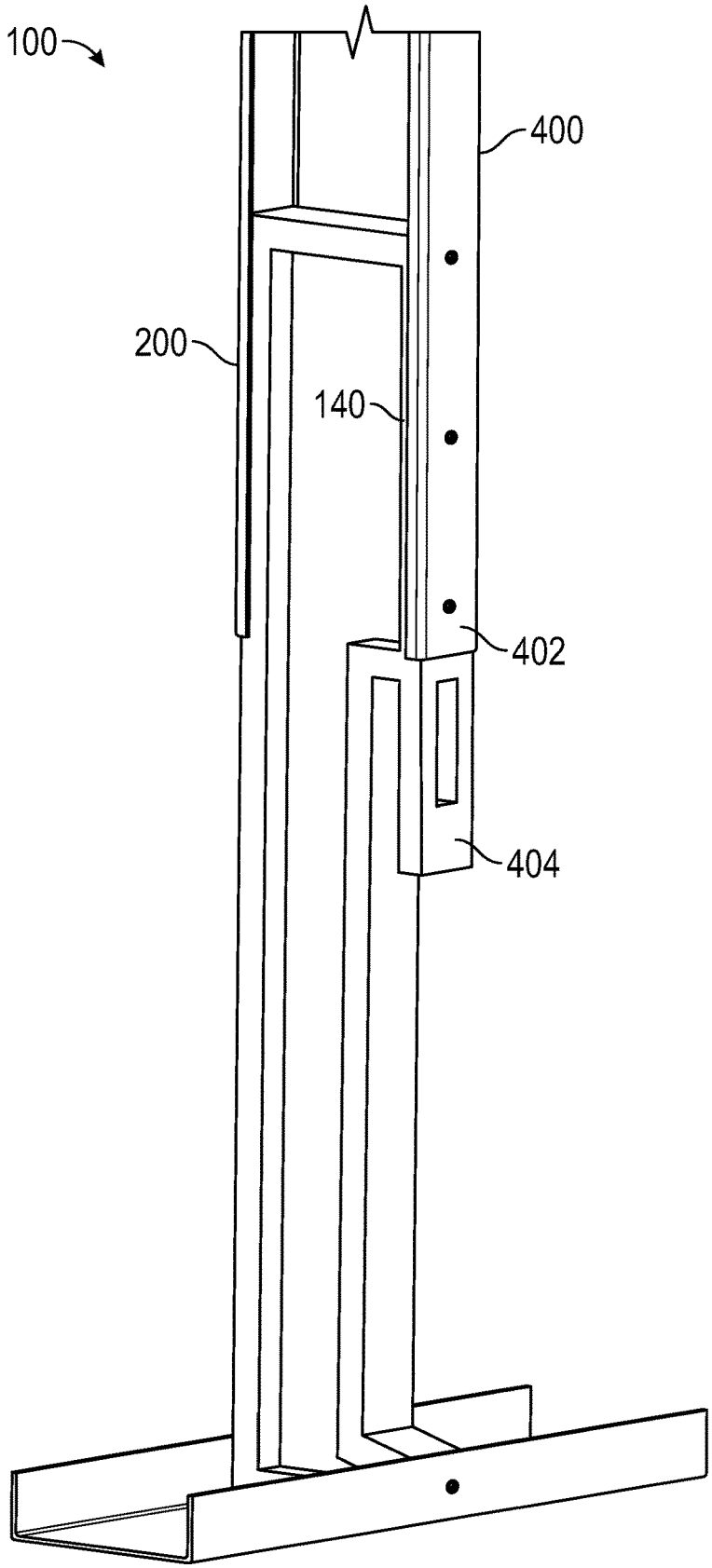
FIG. 4 shows the device attached to a top stud.

FIG. 4 illustrates how the pan liner stud 100 forms the bottom portion of a metal stud 400 which would otherwise be screwed into the metal track 300. The inside surface of the metal stud 400 is slipped over the outer stud attaching surfaces 140, 200 of the pan liner stud 100 thus holding the pan liner stud 100, and attached thereto. This top surface/area of the pan liner stud thus forms a a stud attaching part, having a first surface at a top sized for connecting to the supporting stud 400, the first surface having a front part which attaches to a front of the supporting stud, using the fasteners 402. The stud attaching part has a flat surface 404, adapted for receiving a wall material thereagainst (e.g., wallboard), the flat surface being substantially coplanar with the front part of the supporting stud 400. By substantially coplanar, we mean that the both surfaces are in the close to the same plane, differing only by the thickness of the hollow metal stud which slips over the pan liner stud 100.

the pan liner stud 100 also has a second surface 115 at a bottom that is attached to a bottom stud. Thus, the pan liner stud 100 is held at its top, and the track attachment surface 115 holds the stud liner stud at its bottom.

The pan liner stud 100 thus forms the bottom most portion of a metal stud system. FIG. 5 illustrates how the pan liner itself 500 is located into place on the pan liner stud 100. The pan liner 500 is attached at its top into the stud pocket 141 and screwed in at the top, using a screw 510 (or other fastener) through the slot 145. This holds the pan liner 500 into place inside the recess 125. A fold or curve in the pan liner causes the bottom portion of the pan liner to extend outside the metal stud system. The pan liner is preferably held at its bottom most portion, so that no fasteners need to be placed into the pan liner below its topmost section, thus keeping the pan liner completely sealed against moisture intrusion. In addition, the pan liner stud extends along an area of the recess, in an area over which there is no stud, so that no screws or other fasteners can be placed unintentionally intruding into the pan liner by accident, since there is no stud that is attached over the area of most of that recess.

FIG. 6 illustrates the pan liner 500 sitting in the pocket 136, so that the top of the pan lanel 500 is held within the recess. The wall board 600 is located over outer surfaces of both the stud and the pan liner stud 100, but the wall board, (e.g., drywall) is not fastened at any location below the bottom of the recess, so that the pan liner 500 can not be pierced below that location.

In different embodiments, the pan liner stud 100 can be formed of plastic, resin, or any other material. Preferably, the pan liner stud is formed of a material which can be molded or machined.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A pan liner holding stud attachment part, comprising:

a stud attaching part, having a first surface at a top, sized for connecting to a supporting stud, the first surface having a front part which attaches to a front part of the supporting stud, the stud attaching part having a second surface at a bottom, which is adapted for attaching to a bottom stud, the stud attaching part having a flat surface, adapted for receiving a wall material thereagainst, the flat surface being substantially coplanar with the front part of the supporting stud, the stud attaching part having a recessed surface, below the level of the front part of the first surface, the recessed surface forming a recessed pocket area under the front part of the supporting stud, the recessed pocket area defining a stop surface which defines a limit of an amount by which a pan liner can be extended into the recessed surface.

2. The part as in claim 1, wherein the recessed pocket area has an opening for receiving a fastener therein to hold a pan liner into place at a top of the pan liner.

3. The part as in claim 1, further comprising the pan liner, attached at the top using a fastener and held at the bottom without any fastener going through the pan liner below the level of the top.

4. The part as in claim 1, wherein the stud attaching part is adapted to be attached to metal studs, and front part of the stud attaching part attaches to a front of a metal stud which receives wall material thereon, and a rear surface of the stud attaching part attaches to a rear of the metal stud.

5. The part as in claim 4, wherein the stud attaching part is sized to fit on an inside of the metal stud between the front part of the metal stud and a rear part of the metal stud, and to be attached therebetween.

6. The part as in claim 4, wherein the front surface is attached to a wallboard material.

7. A pan lining attaching part, comprising:

a first surface, sized for attaching to a wall stud, the first surface being at a top of the pan lining attaching part;

a second surface, at a bottom portion of the pan lining attaching part, sized for attaching to a track that holds bottom parts of wall studs;

a third surface, adjacent the first surface, and extending orthogonally to the first surface, forming an area for receiving wallboard attached thereto;

a recess, formed below at least a portion of the third surface, the recess having a portion at a top for holding a pan liner and extending to an area near the second surface to allow the pan liner to extend beyond the second surface, where there is an open area over at least a portion of the recess, preventing fasteners from being placed into the pan liner over an area of said open area.

8. The pan lining attaching part as in claim 7, wherein the first surface fits inside a metal wall stud.

* * * * *